US008997434B1

(12) United States Patent
Socha et al.

(10) Patent No.: US 8,997,434 B1
(45) Date of Patent: Apr. 7, 2015

(54) METHOD OF INSTALLING A FLOORING SYSTEM UTILIZING GYPSUM UNDERLAYMENTS

(75) Inventors: Dennis Albert Socha, Buffalo Grove, IL (US); John Ellicson, McHenry, IL (US)

(73) Assignee: United States Gypsum Company, Chicago, IL (US)

( * ) Notice: Subject to any disclaimer, the term of this patent is extended or adjusted under 35 U.S.C. 154(b) by 0 days.

(21) Appl. No.: 13/451,779

(22) Filed: Apr. 20, 2012

Related U.S. Application Data

(60) Provisional application No. 61/477,464, filed on Apr. 20, 2011, provisional application No. 61/488,594, filed on May 20, 2011.

(51) Int. Cl.
*E04B 1/00* (2006.01)
*E04B 5/32* (2006.01)

(52) U.S. Cl.
CPC ..... *E04B 5/32* (2013.01)

(58) Field of Classification Search
USPC ..... 52/741.4
See application file for complete search history.

(56) References Cited

U.S. PATENT DOCUMENTS

| | | | | |
|---|---|---|---|---|
| 3,795,533 | A | 3/1974 | Lal Gauri | |
| 4,153,743 | A | 5/1979 | Caramanian | |
| 4,810,748 | A | 3/1989 | Spells | |
| 5,061,524 | A * | 10/1991 | Hinterwaldner | 427/385.5 |
| 5,273,787 | A | 12/1993 | Gnatowski | |
| 5,344,856 | A * | 9/1994 | Klein | 523/403 |
| 5,554,672 | A * | 9/1996 | Saito et al. | 523/466 |
| 6,399,181 | B1 | 6/2002 | Corder | |
| 6,586,066 | B1 | 7/2003 | Buckwalter et al. | |
| 6,599,599 | B1 * | 7/2003 | Buckwater et al. | 428/40.1 |
| 6,673,177 | B2 * | 1/2004 | Buckwalter et al. | 156/71 |
| 6,922,963 | B2 | 8/2005 | Simonelli et al. | |
| 7,062,888 | B2 | 6/2006 | Alesi | |
| 7,276,549 | B2 * | 10/2007 | Liu et al. | 524/423 |
| 7,282,264 | B2 | 10/2007 | Ddamulira et al. | |
| 7,779,590 | B2 * | 8/2010 | Hsu et al. | 52/334 |
| 7,886,488 | B2 * | 2/2011 | Payne et al. | 52/144 |
| 2004/0033315 | A1 * | 2/2004 | Trabesinger et al. | 427/386 |
| 2004/0253452 | A1 * | 12/2004 | Ogino | 428/411.1 |
| 2006/0178463 | A1 * | 8/2006 | Sacks | 524/444 |
| 2007/0238827 | A1 | 10/2007 | Brady et al. | |
| 2008/0057206 | A1 * | 3/2008 | Igo et al. | 427/403 |
| 2008/0060299 | A1 * | 3/2008 | Dubey et al. | 52/403.1 |
| 2009/0214879 | A1 | 8/2009 | Jucker et al. | |
| 2010/0062219 | A1 * | 3/2010 | Richards | 428/142 |
| 2010/0068533 | A1 | 3/2010 | Chanvillard | |
| 2010/0077684 | A1 * | 4/2010 | Socha | 52/403.1 |
| 2010/0159254 | A1 | 6/2010 | Oertli et al. | |
| 2010/0247929 | A1 * | 9/2010 | Oertli et al. | 428/446 |
| 2011/0154772 | A1 * | 6/2011 | Lontchar et al. | 52/745.05 |
| 2012/0308795 | A1 * | 12/2012 | Hauber et al. | 428/218 |

(Continued)

OTHER PUBLICATIONS

Mapei, "Primer WE", copyright Mar. 10, 2010.*

(Continued)

*Primary Examiner* — Ryan Kwiecinski
(74) *Attorney, Agent, or Firm* — Greer, Burns & Crain, Ltd.; Brian M. Wishnow; Philip T. Petti

(57) ABSTRACT

A method of installing a flooring system including pouring a gypsum underlayment on a substrate, allowing the underlayment to set, but not dry. A water-borne epoxy sealer is provided and applied to the wet, but set, underlayment.

9 Claims, 1 Drawing Sheet

(56) References Cited

U.S. PATENT DOCUMENTS

| | | | | |
|---|---|---|---|---|
| 2012/0329908 | A1* | 12/2012 | Chen et al. | 523/401 |
| 2012/0329909 | A1* | 12/2012 | Kuehn et al. | 523/401 |

OTHER PUBLICATIONS

"LEVELROCK Brand Floor Underlayment Surface Enhancer SE-100", Submittal Sheet, Copyright 2004. WayBack Machine Feb. 28, 2006—http://web.archive.org/web/20060228104431/http://literature.usg.com/pdf/IG1618.pdf.*

"Material Saftey Data Sheet—LEVELROCK Brand SE-100"—Version Date Jul. 6, 2004 WayBack—Feb. 28, 2006—http://web.archive.org/web/20060228104445/http://literature.usg.com/pdf/57-625-001.pdf.*

"LEVELROCK Brand Floor Underlayment 2500", Sumittal Sheet, Copyright 2004. WayBack—Mar. 2, 2006—http://web.archive.org/web/20060302092648/http://literature.usg.com/pdf/IG1450.pdf.*

"LEVELROCK Floor Underlayment", Installation Guidelines, Copyright 2005. WayBack—Feb. 22, 2006—http://web.archive.org/web/20060222101557/http://literature.usg.com/pdf/IG1457.pdf.*

"Material Safety Data Sheet—LEVELROCK™ Brand Floor Underlayment 2500", Version Date: Oct. 8, 2003 WayBack—Mar. 2, 2006—http://web.archive.org/web/20060302092841/http://literature.usg.com/pdf/57-140-022.pdf.*

Sikafloor FTP Fast Track Primer, Product Data Sheet, Edition 3.3. 2009, Sika Industrial Flooring, A.R. Chambers Supply, 2009.

Levelrock Floor Underlayment, CSD Early Exposure, Submittal Sheet, USG Corporation, 2011.

Levelrock Floor Underlayment, 4500 NXG, Submittal Sheet, USG Corporation, 2008.

* cited by examiner

METHOD OF INSTALLING A FLOORING SYSTEM UTILIZING GYPSUM UNDERLAYMENTS

RELATED APPLICATIONS

This application claims priority under 35 USC 119(e) from U.S. Patent Application Ser. No. 61/477,464 filed Apr. 20, 2011 and U.S. Patent Application Ser. No. 61/488,594 filed May 20, 2011.

FIELD OF THE INVENTION

The present invention relates generally to gypsum based flooring underlayments applied to wood or concrete subfloors, and more specifically to a flooring installation system that provides an improved, hardened underlayment surface and an enhanced bond between the underlayment and specialized elastomeric membranes. Bonding is also enhanced between the underlayment and water-based adhesives, commonly used with finish flooring materials such as rubber flooring tiles and sheets.

BACKGROUND

Flooring underlayments are conventionally applied to new construction or rehab work upon wood or concrete subfloors. Such underlayments are applied as a flowable slurry, and upon setting provide a level substrate that facilitates the application of finished flooring such as wood, tile, resilient flooring and carpet.

The industry standard underlayment is a Portland cement based material. However, gypsum based underlayments, such as LEVELROCK® gypsum underlayment (United States Gypsum Company, Chicago, Ill.) are gaining popularity. A conventional underlayment sealer is often utilized to seal the surface of a gypsum underlayment, but will not harden the surface in situations where unusual circumstances have caused softening of the top surface. Instead, the surface will be chalky, dusty or soft. These situations arise, for example, when a strong draft is present during the setting process, or when the wrong type or too much sand is utilized in the underlayment slurry mixture. Too much sand or the wrong type of sand will often cause addition of an excessive amount of water to achieve flow of the pourable underlayment slurry. A soft surface of a gypsum underlayment is undesirable, and also inhibits the formation of a strong bond with an elastomeric membrane directly applied or with an adhesive for installing a finishing flooring material.

Non-traditional elastomeric liquid coatings are becoming increasingly popular as waterproofing and crack isolation membranes for flooring systems. For example, MAPELASTIC® AQUA DEFENSE (Mapei Products for Building, Inc., Dalton, Ga.) waterproofing and crack isolation membrane is a well known elastomeric membrane. Such elastomeric membranes are coatings that are applied directly to an underlayment, and often take a considerable amount of time, sometimes several days, to develop a bond. The bond that does develop is not usually as strong as one would see with a traditional crack-isolation membrane. Elastomeric membranes are also applied to gypsum underlayments treated with a conventional sealer, creating a bond that is improved over the bond between the membrane and a bare gypsum underlayment surface. However, the bond still may not meet expectations of flooring contractors. Often times, it is possible to separate the elastomeric membrane from the underlayment with a simple knife and peel the coating off in sheets.

NORAMENT® and NORAPLAN® rubber flooring tile and sheet products, manufactured by Nora Systems, Inc. (Weinheim, Germany) are examples of commercially available specialty rubber floor finishing materials that are commonly used in hospitals, large building entryways, schools, and in other similar settings. The underlayment product of choice for hospital (or similar commercial building) renovations and new construction is LEVELROCK® 4500 NXG™, a gypsum-based underlayment manufactured by United States Gypsum Company. Because rubber floor tiles and sheets are not coatings, they are usually bonded to an underlayment with an adhesive, such as a polyurethane.

Conventionally, surface preparation of a LEVELROCK® gypsum underlayment for most traditional water-based adhesives is simply to make sure the surface is clean and dry. When utilizing rubber floor coverings, a polyurethane adhesive is conventionally employed. For example, NORA® 310 adhesive is a polyurethane adhesive recommended by Nora Systems, Inc. for installation of their resilient "rubber" floors. Although they work well with gypsum concrete underlayments, polyurethane adhesives are expensive, adding cost to a floor installation project. Manufacturers of high performance resilient floors also offer less expensive latex-based adhesives. Utilization of a water-based acrylic adhesive is, conventionally, insufficient. For example, NORA® 410 (water-based) adhesive, does not satisfactorily bond a rubber floor finish to a gypsum concrete underlayment, even when the contractor waits three days for the material to bond.

To address this problem, Nora Systems Inc., a manufacturer and installer of resilient rubber floors, recommends a "wet set" method of adhering a rubber floor to an underlayment that involves applying a water-based adhesive and allowing it to become tacky, but not completely dry, before installing the rubber floor. The "wet set" method, however, presents another problem. Any water remaining in the adhesive becomes trapped under the rubber floor, which is non-breathable. Eventually, this water seeps into the surface of the LEVELROCK® gypsum underlayment. As a result, the underlayment softens. In time, there is a failure of the bond between the underlayment and the rubber floor.

Along with the increasing popularity of gypsum based underlayments, elastomeric membranes and rubber flooring, there are problems related to bonding that are not prevalent with conventional cement-based underlayments and more traditional floor finishes.

The hygroscopic nature of gypsum floor underlayments may interfere with bonding between a water-based adhesive or an elastomeric membrane and a surface of a gypsum floor underlayment. Conventional solutions have involved utilization of an acrylic sealer applied to the surface of a dry underlayment. However, because the underlayment must be dry, the logistics and timing of application of these sealers becomes problematic. Conventional acrylic sealers will often trap water within the underlayment if the underlayment is not dry before applying the sealer. Problems associated with trapped water include easy peeling or delaminating of the sealer or other coatings applied to the underlayment.

SUMMARY

The above-identified problems are addressed by the present improved method of installing a flooring system, which provides an improved underlayment surface hardness and improved bonding between the underlayment and an elastomeric membrane or an adhesive. A feature of the present method is that the underlayment need not be dry before it is sealed. Another feature of the present method is that only a few hours, rather than the conventional 14-48 hours, are required for sealer drying before application of other flooring system materials to the underlayment, such as elastomeric membranes and adhesives.

A method of installing a flooring system includes pouring a gypsum underlayment on a substrate, and allowing the underlayment to set, but not dry, thereby saving time. Next, a water-borne (also referred to as water-based) epoxy sealer is provided and applied to the wet, but set gypsum underlayment. While not wishing to be bound by theory, it is believed that the present water-borne epoxy sealer seals the surface of the underlayment without forming a film over the surface of the underlayment. Thus, the underlayment breathes and water vapor passes through the sealer and drying of the underlayment proceeds as it would without being sealed. Applying the sealer to a wet, but set underlayment provides improved efficiency on a job site while reducing problems associated with water that may be trapped under a conventional sealer, thus also improving the performance of the underlayment sealer.

In one embodiment, the sealer is applied as described above, then allowed to dry. A wear-resistant, serviceable floor results. This is an economical way to achieve a serviceable floor for a warehouse or other similar environment.

In another embodiment, an elastomeric water-proofing and crack-isolation membrane is applied relatively soon, optionally within about 2 to about 4 hours, after application of sealer to the gypsum underlayment. Enhanced bonding between the gypsum underlayment and the elastomeric membrane is achieved.

In another embodiment, a finish flooring material such as a rubber floor tile or sheet is installed over a sealed gypsum underlayment according to the above method where the sealer is allowed only a short period, about 2 to about 4 hours, of time to dry. Preferably, a water-based adhesive is used to affix the finish floor tile or sheet to the sealed underlayment. Water-based adhesives are more economical than conventional polyurethane-based adhesives. Polyurethane-based adhesives can cost approximately three times as much as water-based adhesives.

DETAILED DESCRIPTION

Figure 1:
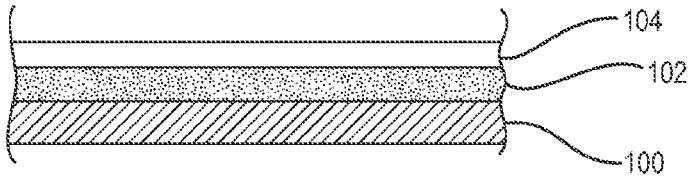
FIG. 1 is a schematic view of a flooring system according to an embodiment of the present method.
Figure 2:
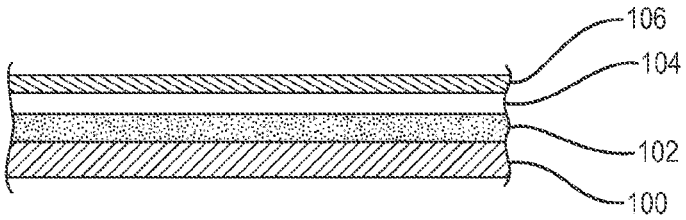
FIG. 2 is a schematic view of a flooring system according to another embodiment of the present method.
Figure 3:
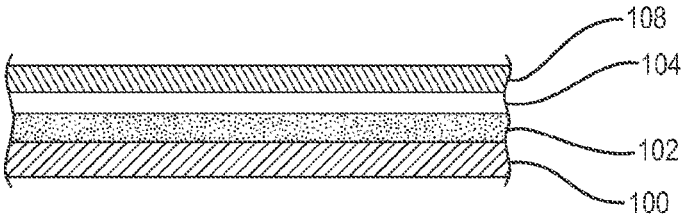
FIG. 3 is a schematic view of a flooring system according to a further embodiment of the present method.

Referring now to FIG. 1, a method of installing a flooring system includes pouring a gypsum underlayment 102 on a substrate 100, and allowing the underlayment to set, but not dry. Time is not wasted on a job site by waiting for the underlayment 102 to dry. Selecting and providing a water-borne epoxy sealer 104 and applying the sealer to the wet, but set, gypsum underlayment 102 is included in the present method.

An example of a gypsum based underlayment for the present method of installing a flooring system is LEVELROCK® self-leveling, pourable gypsum underlayment (United States Gypsum Co., Chicago, Ill.). Preferably, LEVELROCK® underlayment is utilized at a thickness between about 0.64 cm to about 1.9 cm (about ¼ to about ¾ inch), although this can vary depending on job conditions.

An example of a water-borne epoxy sealer is SIKAFLOOR® FTP concrete primer (Sika Corporation, Lyndhurst, N.J.) ("FTP"), a water-borne epoxy material with three components: hardener, resin and water. Although it is manufactured and intended for use as a vapor barrier to be applied over new or old concrete floors that are on grade, the present method utilizes FTP as a gypsum underlayment sealer. Presently, the FTP sealer can be applied 2-4 hours after the underlayment floor has set and can be walked on.

In a variation of the present method, allowing the sealer to dry, preferably for about 4 hours, on the underlayment provides as a finished surface, a hardened underlayment surface suitable as a wear surface for warehouse floors and other similar applications. A feature of this method is that it provides an economical way of achieving a gypsum underlayment-based floor with a wear-resistant, durable and hardened surface. This is preferably achieved by starting with a high compressive strength gypsum underlayment, such as LEVELROCK® 4500 NXG underlayment, which has a minimum compressive strength of 4500 psi, or LEVELROCK® UltraArmor™ underlayment, which has a minimum compressive strength of 3500 psi. This method of hardening the underlayment surface avoids the undesirable effects of soft or dusty surfaces, often caused by having too much water in the underlayment slurry or the presence of a breeze or draft while the underlayment is setting and drying.

In another variation of the present method of installing a flooring system, an improved bond is achieved between gypsum underlayments and finishing materials such as elastomeric membranes, resilient flooring materials, and water-based adhesives, all of which are gaining popularity in new construction and renovations. Under some circumstances at a job site, overwatering of the gypsum underlayment may occur, resulting in an underlayment surface that is very porous and absorbent. Over-watering in some cases may result in the occurrence of a surface scum that will result in poor bonding of adhesives, coatings or other finishes to the underlayment. Advantageously, when FTP is applied to the overwatered underlayment surface, improved bonding and hardening of the gypsum underlayment surface is achieved.

In one embodiment of this variation, an elastomeric, waterproofing and crack-isolation membrane 106 is applied to the gypsum underlayment 102 on the substrate 100. An upper surface of the gypsum underlayment 102 is sealed with a water-borne epoxy sealer 104, such as FTP sealer, while the underlayment 102 is still wet. A preferred gypsum underlayment is LEVELROCK® 2500 or 3500 gypsum underlayment (United States Gypsum Company, Chicago, Ill.). A preferred crack-isolation and waterproofing membrane coating material is MAPEI® MAPELASTIC AQUA DEFENSE® membrane. In the present method, about 2 to about 4 hours lapse between applying the sealer 104 and applying the elastomeric membrane 106. The FTP sealer obtains a tacky quality, but is not permitted the usual 14 to 48 hours to fully dry or cure, as prescribed by the manufacturer, before installing the membrane.

In another embodiment, an enhanced bond is achieved between the sealed gypsum underlayment 102 and water-based adhesives 108 used with a wide variety of resilient floor coverings, ceramic tile thin-sets, and carpet flooring pads. The wet but set gypsum underlayment 102 is sealed with sealer 104, as previously described. An optional gypsum underlayment is LEVELROCK® 4500 NXG™ underlayment, PROFLOW™ underlayment, or QUICK-TOP™ underlayment. A preferred adhesive 108 is a waterbased acrylic adhesive, such as NORA® 410 acrylic adhesive. A preferred resilient flooring material is NORAMENT® specialized rubber flooring, manufactured by Nora Systems, Inc. As described above, the preferred sealer is FTP, which is allowed about 2 to about 4 hours before it is coated with the adhesive 108. In this embodiment, an improved bond between the adhesive 108 and the underlayment 102 results in an improved bond between the gypsum underlayment and the finish flooring material. A finishing material, such as, but not limited to a rubber floor, is quickly installed over the adhesive as is known in the art, and a satisfactory bond between the gypsum underlayment 102 and the rubber floor is achieved. After drying for about 72 hours, the finished flooring is only separated from the underlayment 102 with great difficulty.

An advantage of the immediately above-described embodiment addresses the hygroscopic nature of gypsum underlayments, in which absorption of water from the adhesive can compromise or prevent a bond between the underlayment and the adhesive. This compromised bonding is often further exacerbated with newer, water-based "green" adhesives. An effect of the "green" movement on adhesives is the replacement of oxygenated solvents with water. The present embodiment seals the gypsum underlayment so that water in the adhesive is retained to allow the binding polymers in the adhesive to properly coalesce. Better adhesive performance results.

FTP sealer has three components: hardener (Part "H"), resin (Part "R") and water. A desirable feature of the present method is that the sealer is diluted to obtain a low viscosity. Optionally, it is super-diluted, as described below. If the sealer is applied at the manufacturer's recommended dilution rate, it is usually too expensive for economically installing a flooring system. However, the present system provides for higher dilution ratios. Advantageously, bonding tests reveal that the diluted sealer continues to work at these more economical dilution rates. In one embodiment, the FTP sealer is prepared according to the manufacturer's dilution directions. Optionally, the standard dilution is further diluted with 3 parts water to 1 part standard mixture. In a further dilution, optionally, 5 parts water to 1 part standard mixture is provided. Solids content, on a weight of dry solids basis, of the standard FTP sealer mixture is about 33%. The 3:1 diluted mixture is approximately 12.5% solids, and the 5:1 dilution is approximately 9.0% solids, all on a dry solids weight basis. The present material can be rolled on or spray applied at the rate of about 400 $ft^2$/gallon (about 37 $m^2$/3.8 L).

Viscosity of the mixture decreases as the dilution increases. For example, viscosity of a standard dilution FTP primer mixture was measured to be 40 cps (0.04 $N*s/m^2$), while a 3:1 diluted mixture measured 11 cps (0.011 $N*s/m^2$). Viscosity of the present sealer was measured using a Brookfield DV-II+ Programmable Viscometer. The Brookfield Viscometer is of the rotational variety. It measures the torque required to rotate an immersed element (spindle) in a fluid. The spindle is driven by a motor through a calibrated spring. Deflection of the spring is indicated by a pointer and dial, or by a digital display. By utilizing a multiple speed transmission and interchangeable spindles, a variety of viscosity measurements can be made. Described as a unit of dynamic viscosity, centipoises is the amount of force necessary to move a layer of liquid in relation to another liquid. Centipoises is considered the standard measurement for fluids of all types. It is one hundredth of a poise. The symbol for centipoises is cP or cps.

The conventional approach of sealing a surface with an acrylic sealer is problematic because one must wait until the underlayment has dried or risk trapping water within the underlayment with resultant problems. Advantageously, the FTP sealer does not form a seal. Therefore, it allows the underlayment to "breathe" and water vapor can pass through without affecting the drying rate of the underlayment. This provides the versatility of allowing the FTP sealer to be applied to a wet, but set underlayment. The epoxy resin in the sealer is hydrophobic, resulting in a repulsion of the water and allowing the water molecules to remain in the adhesive envelope. Without this treatment, the underlayment would compete for the water molecules of the adhesive and an incomplete film would form. Without complete film formation of the adhesive, a lessening of the bonding strength is likely to occur. Another unwanted result is a potential for bond failure between the adhesive and the underlayment.

Bonding tests reveal that the material continued to work at these higher, and more economical, dilution rates, which range from Sika's standard mixture to 5 parts water to 1 part standard Sika mix. A preferred dilution ratio is 3:1, to provide an economical application. However, should a job condition result in a softer, dustier chalkier surface, a stronger dilution rate or full strength may be used. The present sealer material can be rolled on or spray applied at the rate of about 400 $ft^2$/gallon (37 m2/3.8 L). The pH of the surface is also an application factor with floor covering adhesive manufacturers, who usually specify that the pH should be lower than 9.0. Advantageously, FTP® sealer has also exhibited the ability to reduce the pH of the treated underlayment surface to meet this requirement.

Table 1 shows test data for several combinations of underlayment, sealer, dry time, and adhesive. The control slab was labeled "Ardex K-15," and is an industry standard Portland cement based underlayment. It was not sealed, yet a fairly good bond was achieved between a Nora rubber floor, utilizing a water-based adhesive, Nora® 410. "Cohesive failure" indicates that a satisfactory bond was achieved, but that under enough stress, the bond failed so that a portion of the adhesive remained on the underlayment and the rest of the adhesive remained with the rubber floor. Because any bond will break if enough force is applied, a cohesive failure, where the break occurs within the adhesive, is a desirable result.

Tests were completed on three LEVELROCK® brand gypsum based underlayments. FTP sealer, if applied, was given 2-14 hours before coating with an adhesive, which was either—based or a polyurethane. Nora rubber floors were installed over the underlayments and the subsequent bond strength was measured.

LEVELROCK® 4500 NXG underlayment and LEVELROCK® Quik-Top underlayment based systems demonstrated improved bonding of the rubber floor when a water-based adhesive was utilized in combination with a sealer that was coated with adhesive for installation of the rubber floor after only 2 hours. LEVELROCK® underlayment, LEVELROCK® 4500 NXG underlayment and QUICK-TOP underlayment embody a unique, self-sealing composition that reduces the need for job application of a sealer for most commonly used adhesives for resilient floor coverings, tile thin-sets and carpet adhesives. However, tests have shown that in the case of high performance rubber flooring and the use of water-based latex (acrylic) adhesive as recommended by the manufacturer, the embodied sealer does not provide needed performance. However, tests have shown that FTP sealer, where applied at the standard dilution, has enhanced the bond strength.

Where no FTP sealer was applied, the bond failed unless a polyurethane adhesive was used. No sealer was applied to the control cement-based underlayment either, and a cohesive failure bond was achieved, which was the desired result.

Where the FTP sealer was diluted 4:1 with water before application to the underlayment, it was allowed 14 hours before coating with adhesive and installation of the rubber floor. Only the LEVELROCK® 3500 bonded to the rubber floor. Where FTP sealer was utilized as is, or undiluted, it was allowed only 2 hours before coating with adhesive. Improved, cohesive bonds were achieved between the gypsum underlayment and the rubber floor.

TABLE 1

| Slab ID | Sealer | Sealer Dry time (hours) | Flooring | Adhesive | Tack Time (minutes) | Bond after 3 days (lbs/in) | Bond after 7 days (lbs/in) | Comments |
|---|---|---|---|---|---|---|---|---|
| Ardex k-15 | none | NA | Nora Rubber | 410 | 15 | 13 | 13 | Cohesive failure |
| LR-3500 | LRAPS | 2 | Nora Rubber | 410 | 15 | 13 | 13 | Cohesive failure |
| LR-3500 | FTP 4-1 | 14 | Nora Rubber | 410 | 15 | 10 | 10 | Cohesive failure |
| LR-4500NXG | none | NA | Nora Rubber | 410 | 15 | 2 | 2 | Failed |
| LR-4500NXG | FTP 4-1 | 14 | Nora Rubber | 410 | 15 | 2 | 2 | Failed |
| LR-4500NXG | FTP as is | 2 | Nora Rubber | 410 | 15 | 7 | 7 | Cohesive |
| LR-4500NXG | none | NA | Nora Rubber | 310PU | 15 | 13 | 13 | Cohesive failure |
| LR-QuickTop | none | NA | Nora Rubber | 310PU | 15 | 13 | 13 | Cohesive failure |
| LR-QuickTop | FTP as is | 2 | Nora Rubber | 410 | 15 | 7 | 7 | Cohesive |
| LR-QuickTop | none | NA | Nora Rubber | 410 | 15 | 2 | 2 | Failed |
| LR-QuickTop | FTP 4-1 | 14 | Nora Rubber | 410 | 15 | 2 | 2 | Failed |

While particular embodiments of the present method of installing a flooring system using gypsum underlayments are disclosed, it will be appreciated by those skilled in the art that changes and modifications may be made hereto without departing from the invention in its broader aspects.

What is claimed is:

1. A method of installing a flooring system comprising:

pouring a gypsum underlayment on a substrate;

allowing the underlayment to set, but not dry;

providing a water-borne sealer including a hardener, a hydrophobic epoxy resin and water; and applying the sealer to the wet, but set underlayment, wherein the sealer partially seals the underlayment to promote permeation of water vapor through the sealer; and applying an adhesive to the gypsum underlayment less than 4 hours after the step of applying the sealer to the gypsum underlayment.

2. The method of claim 1 further comprising allowing the sealer to dry, providing a treated underlayment.

3. The method of claim 2 wherein the pH of the treated underlayment is about 9 or lower.

4. The method of claim 1 wherein the sealer is applied at a rate of about 400 $ft^2$/gallon (37 $m^2$/3.8 L).

5. The method of claim 1 wherein the gypsum underlayment is poured to a thickness between about 0.64 cm-about 1.9 cm.

6. The method of claim 1 further comprising applying a finished flooring to the adhesive.

7. The method of claim 6 wherein the finished flooring is at least one of a resilient flooring material, carpet and tile.

8. The method of claim 1 wherein the adhesive is water-based.

9. A method of installing a flooring system comprising: pouring a gypsum underlayment on a substrate; allowing the underlayment to set, but not dry; providing a water-borne sealing including a hardener, a hydrophobic epoxy resin and water; applying the sealer to the wet, but not set underlayment, wherein the sealer partially seals the underlayment to promote permeation of water vapor through the sealer; and applying an elastomeric water-proofing and crack-isolation membrane within 2-4 hours after the step of applying the sealer to the gypsum underlayment.

* * * * *